US007300331B2

(12) United States Patent
Baran et al.

(10) Patent No.: US 7,300,331 B2
(45) Date of Patent: Nov. 27, 2007

(54) BRASSIERE CONSTRUCTION USING MULTIPLE LAYERS OF FABRIC

(75) Inventors: Joyce I. Baran, Stratford, CT (US); Petros Dafniotis, Greece (CH); Douglas K. Farmer, Greensboro, NC (US)

(73) Assignee: Invista North America S.AR.L., Wilmington, DE (US)

( * ) Notice: Subject to any disclaimer, the term of this patent is extended or adjusted under 35 U.S.C. 154(b) by 101 days.

(21) Appl. No.: 11/248,787

(22) Filed: Oct. 11, 2005

(65) Prior Publication Data

US 2007/0082579 A1 Apr. 12, 2007

(51) Int. Cl.
*A41C 3/12* (2006.01)

(52) U.S. Cl. ..... 450/65; 450/66; 450/74; 450/75; 450/93; 450/92

(58) Field of Classification Search ..... 450/39, 450/40, 43, 92, 93, 44, 65, 66, 68, 74, 75, 450/76; 156/245; 264/257, 258, 291, 292, 264/244, 145, 148, 152–157, 160, 163, 554
See application file for complete search history.

(56) References Cited

U.S. PATENT DOCUMENTS

| | | | | | |
|---|---|---|---|---|---|
| 4,080,416 | A | * | 3/1978 | Howard | 264/258 |
| 4,375,445 | A | * | 3/1983 | Cole et al. | 264/250 |
| 4,419,997 | A | * | 12/1983 | Cole et al. | 450/65 |
| 4,481,951 | A | * | 11/1984 | Cole et al. | 450/20 |
| 4,557,267 | A | * | 12/1985 | Cole | 450/40 |
| 5,447,462 | A | * | 9/1995 | Smith et al. | 450/122 |
| 2005/0221718 | A1 | | 10/2005 | Falla | |

FOREIGN PATENT DOCUMENTS

DE 201 14873 U1 12/2001

* cited by examiner

*Primary Examiner*—Gloria M. Hale
(74) *Attorney, Agent, or Firm*—Christina W. Geerlof

(57) ABSTRACT

A brassiere or breast shaping garment has a pair of breast-receiving cups, each of which is formed with an inner fabric layer and an outer fabric layer. The inner fabric layer is placed in an angular orientation relative to the outer fabric layer. Further, the inner fabric layer and the outer fabric layer have sufficiently isotropic hysteresis.

14 Claims, 13 Drawing Sheets

BRASSIERE CONSTRUCTION USING MULTIPLE LAYERS OF FABRIC

BACKGROUND OF THE INVENTION

The field of the invention is generally related to body-shaping garments, and more specifically, to a brassiere construction or body-shaping garment construction fabricated with multiple layers of elastomeric fabric.

In the garment industry designers seek to develop women's body-shaping garments (e.g., brassieres, lingerie, girdles, stretch pants, and swimsuits) that are comfortable to wear, figure-enhancing, lightweight and aesthetically pleasing. In particular, brassiere constructions have two principal goals: (a) wearer comfort and (b) lift support for the breasts. The two principal goals can be mutually exclusive.

Various types of brassieres have been designed to be lightweight, comfortable and give breast support. Many brassieres incorporate stretchable or elastic materials for wearer comfort. However, many of these brassieres support the breasts by utilizing constrictive materials. For example, constrictive materials may press the breasts against the body with such pressure as to cause irritation and discomfort. Alternatively, constrictive materials may press, bend or poke the wearer's skin. Examples of such constrictive materials used in bra design include, but are not limited to, underwires, heavy elastic materials, pads and seams that press directly on the skin of the wearer. Additionally, as the body moves, the wearer may experience several changes in brassiere position. These changes may impact negatively the comfort of the wearer. For example, the movement may cause the wearer to have areas where the body and the garment are not in direct contact. Furthermore, the garment may slide along the body as movement occurs. The separation of the garment from the wearer's bust during movement typically results in an undesirable loss of body shaping or support. Comfort of the garment may be impacted as well. Wearer movement and resulting shifting of the garment may cause the wearer to reposition the garment back to its original position on the body to achieve original comfort and shaping U.S. Pat. No. 4,481,951 to Cole et al., entitled "Method of Fabricating Two Layer Cups and Brassiere," which issued Nov. 13, 1984, discloses a brassiere cup molded from two layers of stretchable materials. However, the resulting cup has a non-stretchable crown portion, a substantially non-stretchable longitudinal cup portion and a unitary multidirectional stretchable periphery. The lack of stretch in the cup after molding, limits wearer comfort and garment shaping ability.

U.S. Pat. No. 5,447,462 to Smith et al., entitled "Fabric Laminate and Garments Incorporating Same," which issued Sep. 5, 1995, discloses a multiple-layer stretch fabric used to form discrete portions of a garment in which it is desired to provide certain control properties. Although the selective use of stretch control laminate fabrics provided a step forward in the art, the fabric laminates of the '462 patent are intended to be used only selectively and not over the entire body of the garment. If the materials of the '462 patent were used as the principal fabric forming the garment, either the garment would be too constricting, and/or the entire garment (rather than only selected portions of the garment) would have the same controlling features throughout.

German Patent No. DE20114873, entitled "Brassiere," which published Nov. 11, 2001, discloses two padded bra cups that are at least partly isolated from each other. In addition, each padded bra cup includes two stretchable woven fabric layers. However, the two stretchable woven fabric layers are essentially flexible along only one axis (i.e., either along the X-axis or Y-axis, but not both). That is, the '873 patent discloses the inner and outer fabric layers are each only elastic in one direction while they exhibit in all other directions practically no or at least very little elasticity. Although the use of these stretchable woven fabrics was yet another step forward, the limitation of the stretchable direction to only one axis restricts the potential level of comfort and control provided by the brassiere formed with such fabrics. In addition, the '873 patent shows a woven fabric with capability of stretching in one direction rather than an elastomeric knit fabric that would have increased capability of stretching in multiple directions. Furthermore, brassieres with woven fabric cups are a niche market, with the majority of brassieres being made with knitted fabrics.

U.S. patent application Ser. No. 10/506,228 to Falla entitled "Brassiere" which published Oct. 6, 2005, discloses a brassiere that has two layers of fabric and an anchor support panel in the cup. The three layers are preferably made of fabric with one-way stretch. The anchor causes the brassiere to remain flat against the body of the wearer. The application teaches away from the garment of the present invention as it states that brassieres formed primarily of stretchable fabrics may not provide sufficient support.

It should be noted that three dimensional shaping ability with minimal garment slippage on the body and dynamic body shaping typically is not available in brassiere cup designs (e.g., cups made from two-ply stretchable fabrics). In fact in typical brassieres, wearer movement causes loss of shaping ability and garment slippage. Moreover, though brassiere constructions have been implemented with LYCRA® (a registered trademark of and commercially available from Invista S. à r. I. of Wichita, Kans. and Wilmington, Del.) elastane products, further improvement in the level of comfort, shaping ability and support of such LYCRA®-based products is a desirable goal.

Therefore, there is a need for body-shaping garments that have multiple layers of elastomeric knitted fabrics, such as LYCRA® spandex-containing fabrics, or at least fabrics stretchable in more than one direction, that can provide improved comfort, shaping ability and support to the wearer.

SUMMARY OF THE INVENTION

The present invention utilizes advances in the development of new fabrics in an engineered brassiere construction that contains multiple layers of fabric to provide for maximum comfort, shaping and control of the body of the wearer of a brassiere or other body shaping garment during movement and/or static conditions. It has been found advantageous to include multiple layers of particular materials in selected locations in a brassiere (e.g., bra cups or wings) in order to better provide the desirable features of comfort, body shaping and support. In the present invention, the layers of these fabrics may take on predetermined shapes and may be arranged in predetermined orientations relative to each other in the design of the cups of the brassiere construction. The layers of these fabrics may be used either alone or in combination with other materials that are sewn or otherwise applied to the fabrics. The layers of fabrics in the garment of the present invention may be molded. One embodiment of the present invention is a body-shaping garment such as a brassiere, comprising: a breast-receiving cup having an inner fabric layer and an outer fabric layer. In addition, in this embodiment the inner fabric layer defines a first X-X' axis and first Y-Y' axis and the outer fabric layer defines a second X-X' axis and second Y-Y' axis, and the inner fabric layer and outer fabric layer are oriented such that the first X-X' axis of the inner fabric layer is at a first angle $\Theta_1$ to the second X-X' axis of the outer fabric layer. In order to ensure that garments of the present invention have 3D shaping ability, minimal slippage on the body, and maximum wearer comfort, the fabrics used to make such garments may have particular isotropic hysteresis properties. Further, for this embodiment of the present invention, the inner fabric layer and the outer fabric layer incorporate a material having hysteresis values for each fabric layer with an S value defined by:

$$S = \frac{\mathrm{std}(H_{L\&L}, H_{W\&W}, H_{L\&W})}{\mathrm{mean}(H_{L\&L}, H_{W\&W}, H_{L\&W})} \times 100\% \leq 10\%.$$

Further, in the above embodiment of the present invention, the brassiere comprises: a left cup; a left wing part; a left shoulder strap; a bridge; a right cup; a right wing part; a right shoulder strap; a fastener; and a mating fastener or hook band. Furthermore, in the above embodiment of the present invention, the left cup is attached at one edge to the left wing part and at an other edge to one end of the bridge, the left shoulder strap is connected at one end to a distal end of the left wing part and at an other end to an upper part of the left cup, the right cup is attached at one edge to the right wing part and at an other edge to one end of the bridge, the right shoulder strap is connected at one end to a distal end of the right wing part and at an other end to an upper part of the right cup. Moreover, in the above embodiment of the present invention, the fastener is connected to the distal end of the right wing part and the mating fastener is connected to the distal end of the left wing part.

The present invention includes a brassiere comprising a pair of cups, each of which further comprises an inner fabric layer and an outer fabric layer. In addition, the brassiere may include an angular orientation of the inner fabric layer relative to the outer fabric layer that can be determined by a value of a first angle, $\Theta_1$. Further, the inner fabric layer and the outer fabric layer have sufficiently isotropic hysteresis as defined further in the specification that allows the brassiere to conform to movements of the breasts with minimal slippage on the body.

The brassiere may be at least one of an unbanded underwire, a banded underwire, a hidden underwire, a demi-cup underwire, a soft cup invisible support and a triangle soft cup minimal bra. The pair of cups may be at least one of full, half or partial coverage type cups. The brassiere may also be molded.

The inner layer of fabric defines crossed axes $X_4$-$X'_4$ and $Y_4$-$Y'_4$, and the outer layer of fabric defines crossed axes $X_6$-$X'_6$ and $Y_6$-$Y'_6$. A first angle $\Theta_1$ is defined as the angle between axes $X_4$-$X'_4$ and $X_6$-$X'_6$. The first angle $\Theta_1$ may vary from about 15 degrees to about 165 degrees. The second angle $\Theta_2$ is defined as the angle between a direction of maximum elasticity of the outer fabric layer (i.e., $X_6$ in FIG. 1) and a horizontal direction of the garment (i.e., $X_g$ in FIG. 1). The second angle $\Theta_2$ can vary from 0 degrees to 180 degrees.

Variation of the first angle $\Theta_1$, the second angle $\Theta_2$ and the isotropic hysteresis of each the inner fabric layer and outer fabric layer may determine the shaping, comfort and control of the brassiere. The first angle $\Theta_1$ and the second angle $\Theta_2$ may be predetermined in accordance with at least one of bust shape, bust density, and bust volume. By varying the angles $\Theta_1$ and $\Theta_2$, it can be possible to change the bust appearance, shape, and volume by changing the cup construction.

The shaping further comprises at least one of a minimizing effect, an up-lifting effect and a fuller bust effect. The shaping may be fully maintained during movement in multiple directions while at the same time the garment may stay in full contact with the wearer's body.

In a non-limiting example of the present invention, the fabrics have elastomeric properties and isotropic hysteresis values. By using these types of fabrics, the present invention may provide softer and suppler body shaping garments with an even greater level of comfort and shaping ability than those produced by the known methods.

BRIEF DESCRIPTION OF THE DRAWINGS

The invention can be described in greater detail with the aid of the following drawings.

DETAILED DESCRIPTION

The present invention is a system for the construction of a body-shaping garment with integrated shaping ability provided by the fabric employed in the cups and wings of a brassiere design. In particular, the combination of (a) the variable shaping ability of the fabric layers and (b) the design of the brassiere cup of the present invention produces a more comfortable fit for the cup and wing sections of brassieres. In order to ensure that garments of the present invention have 3D shaping ability, minimal slippage on the body, and maximum wearer comfort, the fabrics used to make such garments may have particular isotropic hysteresis properties.

More specifically, the present invention provides for the construction of brassiere cups for more comfortably shaping and controlling the breast tissue. In the present invention, fabrics with elastomeric or stretchable properties form the brassiere cup. Fabric orientation is defined by a coordinate system with axes X-X' and Y-Y' defined as follows. The X-X' axis is the direction of maximum stretch of the fabric. For a warp knitted fabric, this is usually the warp direction. The Y-Y' axis is the direction perpendicular to the X-X'axis. The warp and weft directions of an inner fabric layer are oriented at an angle $\Theta_1$ in the range of 15 degrees to 165 degrees relative to the warp and weft direction of an outer fabric layer. This orientation of the inner and outer fabric layers relative to each other, along with the material properties of the fabric layers, may provide a brassiere cup with three dimensional shaping ability. This shaping ability can be applied to the breast tissue to provide comfort, shaping ability and support for the wearer.

Further, the present invention also may provide the ability to shape breast tissue in multiple brassiere silhouettes. Examples of possible brassiere silhouettes to which the present invention may be applied include, but are not limited to, unbanded underwire, banded underwire, hidden underwire, demi-cup underwire, soft cup invisible support (i.e., no underwire), and triangle soft cup minimal bra.

Furthermore, the brassiere construction of the present invention finds application in at least brassiere sizes up to and including 44DD, for example up to and including 40D. Though larger size brassieres typically are made with raschel warp knits, fabric constructions that can be used with the system and brassiere cup design of the present invention may comprise, but are not limited to, at least tricot warp knits, raschel warp knits, circular knits, lace, flat knits, wovens, and nonwoven fabrics that are at least capable of stretching in multiple directions. Though these fabrics may have lower modulus than typical raschel warp knit fabrics such as those made with LYCRA® T902C spandex, they can be employed with the present invention to improve comfort, shaping and control.

Figure 1:
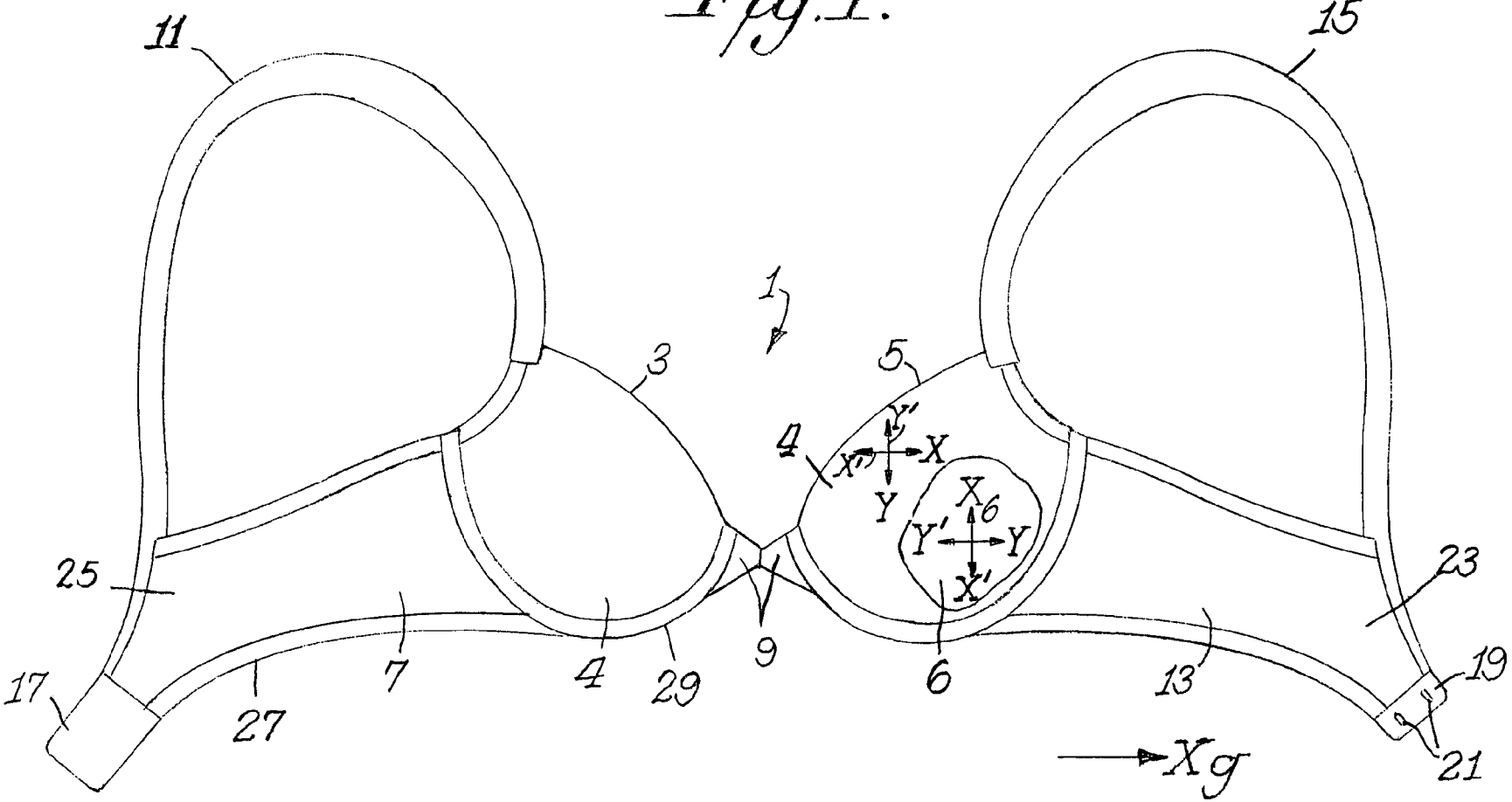
FIG. 1 shows a rear view of an exemplary brassiere construction of the present invention in an unbanded underwire brassiere silhouette.

The exemplary drawing of FIG. 1 shows a first brassiere construction of the present invention. In particular, FIG. 1 shows a rear view of an exemplary embodiment of the present invention of a brassiere 1 at least comprising: cups 3, 5, side panels or wings 7, 13 and shoulder straps 11, 15. FIG. 1 shows an inner side of the brassiere intended to be in contact with a wearer's skin when the brassiere is worn.

The design of the left cup 3 is the mirror image of the right cup 5. The design of the cups 3, 5 will be shown and discussed in more detail in FIG. 2 and FIG. 3. The cups 3, 5 may further comprise an underwire (not shown) contained in a sheath 29 that surrounds such underwire. Each of the cups 3, 5 has an inner fabric layer 4 and an outer fabric layer 6. The inner fabric layer 4 and outer fabric layer 6 are made of a fabric that is at least stretchable in multiple directions and demonstrates nearly isotropic hysteresis. Alternately, the cups 3, 5 may be joined to the wings as a continuous piece of fabric.

Each of the wings 7, 13 shown in FIG. 1 may taper to narrower portions 23, 25 as the wings/panels extend away from the cups toward the distal ends thereof. Alternatively, the wings/panels 7, 13 may retain the same width throughout their length from the proximal portion adjacent to the cups 3, 5 to the distal ends. The wings 7, 13 may further comprise multiple layers of fabric, or fabric with different mechanical properties along the warp and weft directions.

The shoulder straps 11, 15 shown in FIG. 1 may further comprise at least one of an elastic and a non-elastic portion. The shoulder straps 11, 15 may further comprise padding (not shown) on the surface that contacts the skin of the wearer. In addition, the shoulder straps 11, 15 shown in FIG. 1 may further comprise means for adjusting the length (not shown) of the shoulder straps 11, 15. The means for adjusting the length of a shoulder strap may comprise, but is not limited to, a multiple section clasp, clip or the like through which the shoulder strap 11, 15 may be looped in order to adjust the overall length of the shoulder strap.

The brassiere 1 of FIG. 1 further comprises a left cup 3, a left wing part 7, a bridge part 9, a left shoulder strap 11, a right cup 5, a right wing part 13, a right shoulder strap 15, a fastener 17 and a mating fastener or hook band 19. The left cup 3 is attached to the left wing part 7, the bridge 9 and the left shoulder strap 11. The left shoulder strap 11 is connected at one end to a distal end of the left wing part 7 and at the other end to the left cup 3. The right shoulder strap 15 is connected at one end to a distal end of the right wing part 13 and at the other end to the right cup 5. Other arrangements at the back of the brassiere can be possible. The wing parts 7, 13 of the brassiere 1 are interconnected by connecting one or more fasteners 21 (such as hooks) on tape 19 to the mating fastener (not shown) on band 17. The fastener 17 may further comprise at least one of a hook tape and an eye tape or the like to enable interconnection with the hook band 19.

The brassiere 1 of FIG. 1 may further comprise an underwire (not shown) that is introduced into a sheath 29 that consists of fabric and provides padding of the underwire. The sheath 29 is sewn or otherwise attached to at least one of the cups 3, 5, wings 7, 13 and/or the bridge 9 over at least part of their respective lengths and provides additional support. The underwire limits the cups 3, 5 and wings 7, 13 at the lower and upper edges and the side edges. For example, the underwire exhibits a flattened cross section profile that does not have sharp or disturbing corners and edges that could be felt by the wearer and make the brassiere 1 uncomfortable. The cups in the brassiere of FIG. 1 may be molded.

Figure 2:
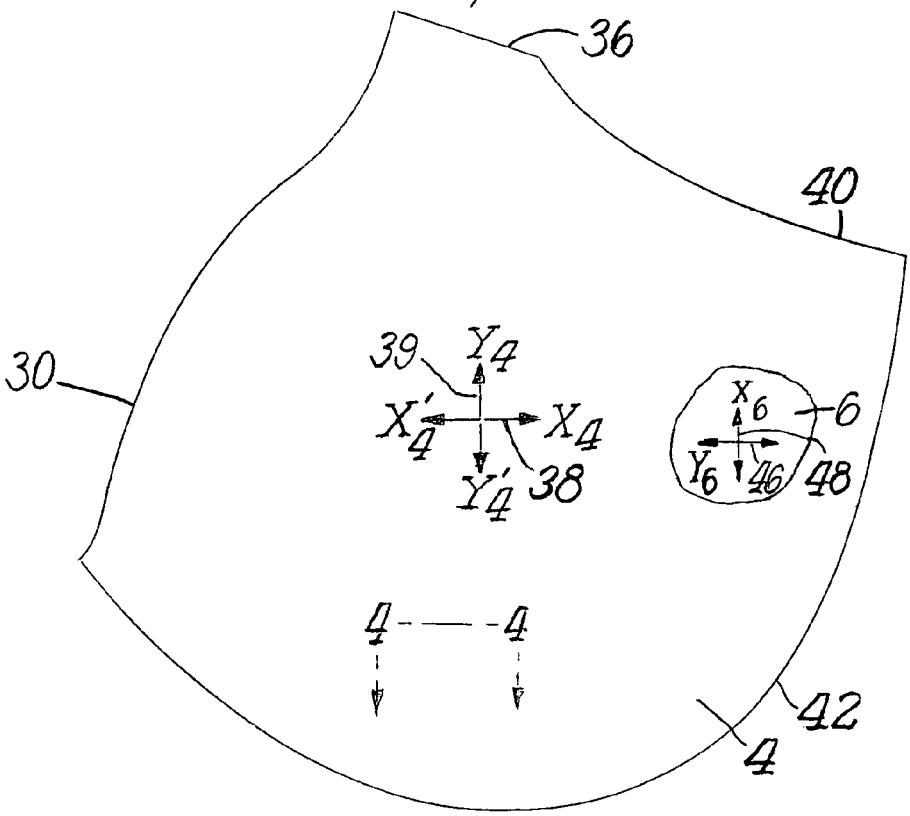
FIG. 2 shows a rear view of an exemplary brassiere cup design for a multiple layer "plus (+)" orientation of the inner fabric layer and outer fabric layer of the cups of the brassiere construction of FIG. 1.
Figure 3:
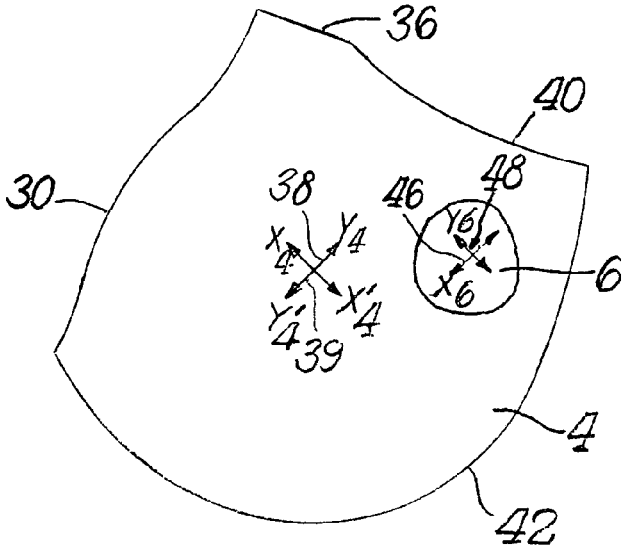
FIG. 3 shows an alternate rear view of an exemplary brassiere cup design for a multiple layer "cross (X)" orientation of the inner fabric layer and outer fabric layer of the cups of the brassiere construction of FIG. 1.

FIG. 2 shows an exemplary brassiere cup design for an alternate or multiple layer "plus (+)" orientation of the inner fabric layer and outer fabric layer of the cups of the brassiere construction. In particular, as shown in FIG. 2, the inner fabric layer 4 has a predetermined four-sided peripheral shape with a sinusoidal first edge 30, a convex second edge 42, a concave third edge 40 and a straight fourth edge 36. The predetermined shape can give vertical lateral lift in varying directions. The inner fabric layer 4 is located beneath the outer fabric layer 6 in a brassiere construction. The inner fabric layer 4 shown in FIG. 2 has a standard orientation of a horizontal $X_4$-$X_4$'-axis 38 and vertical $Y_4$-$Y_4$'-axis 39. Alternatively, the $X_4$-$X_4$' axis can be vertical and the $Y_4$-$Y_4$' axis can be horizontal. The $X_4$-$X_4$' and $Y_4$-$Y_4$'-axes 38, 39 in FIG. 2 correspond to the warp and weft directions, respectively, on the fabric forming the inner fabric layer 4. Note that the shapes for the brassiere cups in FIG. 2 and FIG. 3 are exemplary only for the brassiere shown in FIG. 1. Other bra designs and sizes will warrant different cup shapes.

The outer fabric layer 6 has a predetermined peripheral shape which is equivalent to the inner fabric layer 4. The outer fabric layer 6 is located on top of the inner fabric layer 4. The outer fabric layer 6 has a vertical axis $X_6$-$X_6$'-axis 48 and a horizontal $Y_6$-$Y_6$'-axis 46. The horizontal $Y_6$-$Y_6$'-axis 46 is rotated +/−90 degrees relative to the $Y_4$-$Y_4$'-axis 39 of the inner fabric layer 4. The combination of relative orientation of the fabric layer axes and the angle between the layers and the garment axes can contribute to integrated three-dimensional (3D) shaping ability of the garment.

Warp direction of a knit fabric is the length or machine direction of the fabric. The machine direction is the direction in which the fabric comes off the machine. In warp knitting, the yarns are knit along the length of the fabric. In weft knitting, the yarns are knit across the fabric in the weft direction or the cross direction. In general terms, the warp direction refers to the length of a fabric. The weft direction refers to the width of a fabric. The X-X' axis represents the warp direction. The Y-Y' axis refers to the weft direction (or cross) direction of the fabric. Alternately, the warp and weft directions may refer to the Y-Y' and X-X' axes respectively. LYCRA® spandex fiber typically is knit as bare yarn in the weft direction of the fabric for weft knits and in the warp direction for warp knit fabrics. The methods to make these fabrics are well known to those of ordinary skill in the art.

The inner and outer fabric layers 4, 6 are sewn together at the edges prior to sewing to ease the garment sewing process. The shapes of the inner and outer layers are a function of design and desired fit. The layers are joined using for example a single needle, ZigZag, or Overlock stitch. Padding between the fabric layers 4, 6 may or may not be used. In the exemplary garment in FIG. 1, no padding was used.

The garment in FIG. 1 was constructed of warp knit fabrics containing LYCRA® T902C spandex and nylon (commercially available from Penn Asia Co. Ltd. of Samutprakarn, Thailand) molded on a bullet post-molding machine (commercially available from Optotexform of Wolfegg, Germany). The molded cup was formed by heating the cup and forcing a heated rounded cylinder mold (bullet) into the fabric for a desired amount of time at a temperature causing permanent deformation of the fabric. Techniques for molding fabric for brassiere cups are well known to those skilled in the art. The bullet mold temperature was 204° C. with a cavity temperature of 190° C. and dwell time of 55 seconds. Two mold sizes were used for D cups a 4.5 inch diameter mold was used. For B cups a 3.5 inch mold diameter was used. Three sizes of bras were made, 34B, 34D, and 40D. The data reported are for a size 34B bra.

A first angle $\Theta_1$ is defined as the angle between the $X_4$-$X'_4$ axis 38 and $X_6$-$X'_6$ axis 48 (see FIG. 2). For example, in the embodiment shown in FIG. 2 $\Theta_1$ is about 90 degrees. A second angle $\Theta_2$ is defined as the angle between the $X_6$ axis in the outer fabric layer and a horizontal direction of the garment $X_g$ (see FIG. 1). For example, in the embodiment shown in FIG. 1, $\Theta_2$ is about 90 degrees. By varying the angles $\Theta_1$ and $\Theta_2$, in the cup construction it may be possible to change the bust appearance, shape, and volume. The angle $\Theta_1$ can be from about 15 to about 165 degrees, for example from about 15 to about 90 degrees. The angle $\Theta_2$ can be from about 0 to about 180 degrees, for example 90 degrees, or for example 45 degrees. The shaping ability of a garment will be influenced by the angles $\Theta_1$ and $\Theta_2$ in the garment design. Optimal angles $\Theta_1$ and $\Theta_2$ should be chosen carefully to achieve the desired shaping.

FIG. 3 shows an exemplary brassiere cup design for another alternate or a multiple layer "cross (X)" orientation of the inner fabric layer 4 and outer fabric layer 6 of the cups of the brassiere construction. In particular, as shown in FIG. 3, the inner fabric layer 4 has the same predetermined shape as shown in FIG. 2, and is located beneath the outer fabric layer 6. The inner fabric layer 4 shown in FIG. 3 has an orientation with a vertical $X_4$-$X_4$'-axis 38 and horizontal $Y_4$-$Y_4$'-axis 39 each of which is rotated 45 degrees relative to the standard orientation discussed above with respect to FIG. 2. Alternatively, the $X_4$-$X_4$'-axis 38 can be horizontal and the $Y_4$-$Y_4$'-axis 39 can be vertical. In addition, the outer fabric layer 6 is has the same predetermined shape as shown in FIG. 2, and is located on top of or over the inner fabric layer 4. The outer fabric layer 6 has a vertical $Y_6$-$Y_6$' axis 48 that is rotated +/−90 degrees relative to the $Y_4$-$Y_4$'-axis 39 of the inner fabric layer 4. This orientation of fabric layer 6 over fabric layer 4, as shown in FIG. 3, with Y-Y' axes 39, 48 rotated, as compared to the orientation shown in FIG. 2, provides the "X" orientation. In the embodiment shown in FIG. 3, $\Theta_1$ is about 90 degrees and $\Theta_2$ is about 45 degrees.

Figure 4:
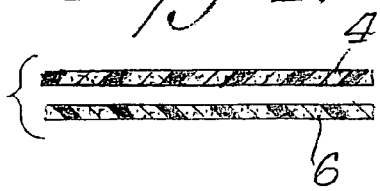
FIG. 4 shows a partial cross-section in exploded view of the brassiere cup design taken along line 4-4 of FIG. 2.

FIG. 4 shows an expanded cross-sectional view of the brassiere cup design of FIG. 2. Inner fabric layer 4 is shown spaced apart from outer fabric layer 6. In a brassiere construction, such layers may be adjacent to one another, but still will have freedom of stretch and recovery movement to take advantage of the stretch power and rotated orientation as described with reference to FIG. 2 and FIG. 3.

The fabric layers 4, 6 comprise at least one of an elastomeric fabric or at least a fabric stretchable in multiple directions. For example, layers 4, 6 of the brassiere design comprise LYCRA® T902C spandex, a copolyether-based, clear spandex with high elongation and uniquely flat stress/strain behavior. The fabric of the layers 4 and 6 may have the isotropic hysteresis property described in the specification. In order to ensure that garments of the present invention have 3D shaping ability, minimal slippage on the body, and maximum wearer comfort, the fabrics used to make such garments may have particular isotropic hysteresis properties.

Layers 4, 6 of the brassiere 1 may comprise, but are not limited to, circular knit, tricot warp knit, raschel warp knit, lace, flat knit and nonwoven fabric that are at least capable of stretching in more than one direction. Though these fabrics may have lower holding power and elasticity modulus than elastomeric fabrics in the Examples, such as fabrics made with LYCRA® T902C spandex, they can be employed with the present invention to improve comfort, shaping and support as long as the particular isotropic hysteresis properties are maintained. As an additional alternative, the fabric layers 4, 6 may be a combination of elastomeric and/or stretchable fabrics that produce the desired result of improved shaping, comfort and support to the body of the wearer of the garment.

The layers 4, 6 of the bra cup of the present invention may comprise multiple layers of laminated material. For example, the cup may comprise a layer of a single fabric, or a layer may comprise one or more layers of fabric joined with an adhesive. The bra cup also may comprise more than two layers of fabric. In certain designs, it is desirable and perhaps even necessary to provide more than two and up to five layers of fabric. For example, in a demi cup brassiere of FIG. 9, additional layers can be used to provide the breast shaping and lifting. Techniques for bra design and use of multiple, layers are familiar to those skilled in the art.

The layers of the bra cup may be molded. For example the cup may be molded at about 200° C. for about one minute. A bullet or sculpture mold may be used, for example a bullet mold may be used to form the desired cup shape. Done properly, molding does not limit the shaping ability of the garment, but complements the bra design and fabric properties for optimal shaping. Techniques for bra molding are familiar to those skilled in the art of brassiere garment making.

Figure 5:
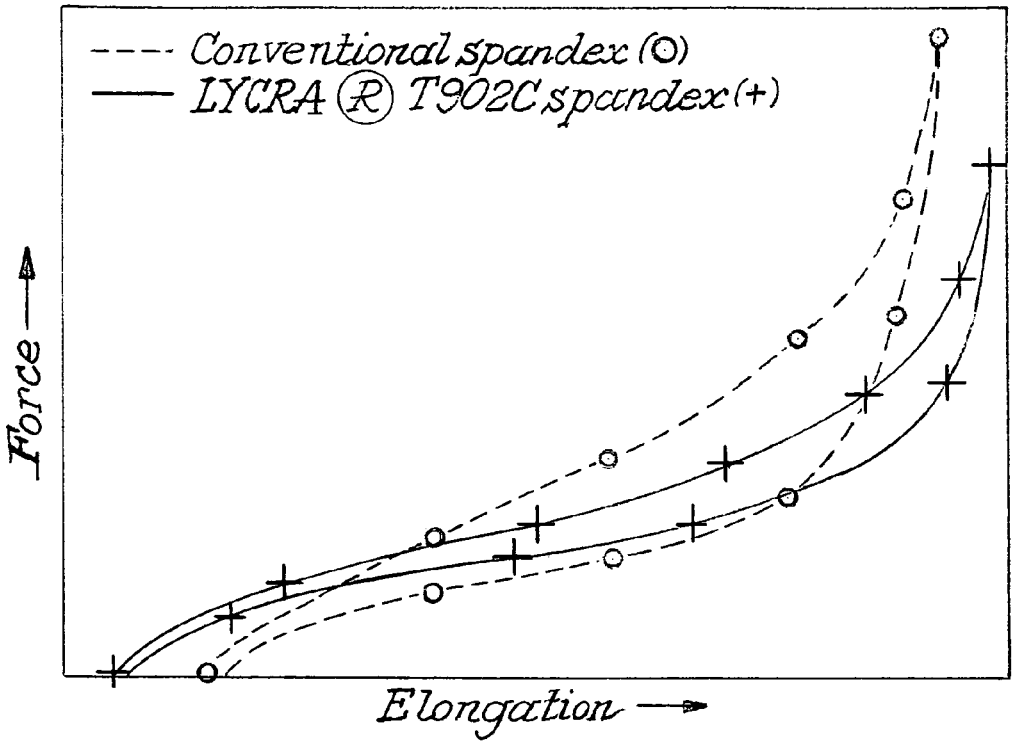
FIG. 5 shows stress/strain curves for conventional spandex fiber and LYCRA® T902C spandex elastomeric fiber which can be used to make fabric for garments of the present invention.

Though conventional spandex has been used in brassiere constructions, the fabric layers 4, 6 of the present invention have different characteristics from those of conventional spandex fabrics. These differences are illustrated in the graph of FIG. 5, which describes fiber mechanical properties. In particular, FIG. 5 shows the stress/strain hysteresis curves for conventional spandex fiber and for LYCRA® T902C spandex fiber, which fibers can be used to make fabrics used in garments of the present invention. The top-line of each curve represents the force required to stretch or elongate the fiber (i.e., the load force). The bottom line of each curve represents the recovery (i.e., the unload force) the fiber exerts at a given elongation. The unload force is always lower than the load force because of a phenomenon known as "stress decay." The area inside the stress/strain curve is the hysteresis. The larger the difference between the load and unload forces, the greater the hysteresis.

FIG. 5 shows that less force is required to stretch the elastomeric fiber which can be used to make fabrics used in garments of the present invention than conventional spandex fiber. In addition, due to the low hysteresis of the elastomeric fiber as shown in FIG. 5, the recovery power of the fabric layers made with such a fiber is greater throughout the donning and wear regions. As a result of the low force characteristic of the fabric layer material, the wearer experiences little or no perceptible resistance to stretch movements. As a result of the low hysteresis characteristic of the fabric layer material, the fabric quickly recovers its shape and closely conforms to the body of the wearer. That is, the garment of the present invention may conform and may maintain contact with the body throughout a wide range of movements by the wearer. Additionally, the garment of the present invention may avoid slipping or sliding on the wearer's body. As a result, the garment may maintain the desired shaping during movement and wear.

A non-limiting example of an elastomeric fabric that is applicable to the present invention is fabric containing LYCRA® T902C spandex. LYCRA® T902C spandex is a co-polyether-based, clear spandex with high elongation and relatively flat stress/strain behavior. Use of LYCRA® T902C spandex-containing garments of the present invention may provide a brassiere cup that fits firmly and closely conforms to the body of the wearer. As a result, the present invention may provide improved comfort as compared known brassiere constructions made with conventional elastomers or other materials.

In order to ensure that garments of the present invention have 3D shaping ability, minimal slippage on the body, and maximum wearer comfort, the fabrics used to make such garments may have particular isotropic hysteresis properties. Fabrics that can be used for the garment of the present invention are described below. Instron experiments were used to determine the fabric hysteresis property that will give the desired effect in the garment of the present invention. The experiments were carried out for each fabric as follows: 1) Length-Length (L&L) two pieces cut with the warp direction on the long edge were placed directly on top of each other and tested on the Instron; 2) Width-Width (W&W) two pieces cut with the weft direction on the long edge of the fabric were placed directly on top of each other and tested on the Instron; and 3) Length-Width (L&W) one piece cut along the warp direction of the fabric and a second piece cut along the weft direction were placed directly on top of each other and tested on the Instron. The hysteresis calculated with this method is shown for three fabrics in Table 1. The low variance of the three measurement techniques defines the fabrics that are suitable in garments of the invention. The same low variance between L&L, W&W and L&W results holds for Fabric A under a variety of different strain rates at the Instron and different initial conditions: 1) Elongations of 30% (i.e., from 10 cm to 13 cm distance),); 2) Instron strain rate of 500 mm/min instead of 900 mm/min; and 3) Elongating the fabric by 20% holding it there for 5 min and then cycling several (i.e., more than 5) times by 20%.

Garments of the present invention comprise a fabric demonstrating the result S for the experiment in L-L, W-W and L-W such as:

$$S = \frac{\mathrm{std}(H_{L\&L}, H_{W\&W}, H_{L\&W})}{\mathrm{mean}(H_{L\&L}, H_{W\&W}, H_{L\&W})} \times 100\% \leq 10\%,$$

can be used in the present invention. Nearly isotropic hysteresis is defined as having an S value to fit the above equation. S is defined as the standard deviation between the three hysteresis data points ($H_{L\&L}$, $H_{W\&W}$ and $H_{L\&W}$) divided by the mean and then multiplied by 100%. $H_{L\&L}$ is defined as the hysteresis measured when two layers of fabric cut along the length are tested. $H_{W\&W}$ is defined as the hysteresis measured when two layers of fabric cut along the width are tested. $H_{L\&W}$ is defined as the hysteresis measured when two layers of fabric one cut along the length and the second cut along the width are tested in the method described in the Example section.

As shown in the tests results given below, when the present invention utilizes elastomeric fabrics made with fibers like LYCRA®T902C spandex or other stretchable fabrics, the shaping ability and comfort provided to the wearer are improved over known fabrics and brassiere constructions.

Figure 6:
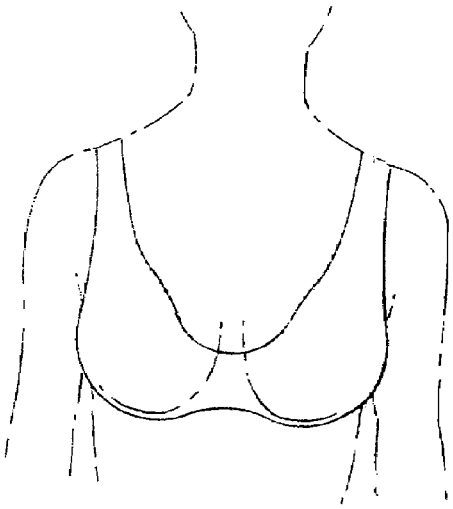
FIG. 6 shows an example of an unwired soft cup brassiere.
Figure 7:
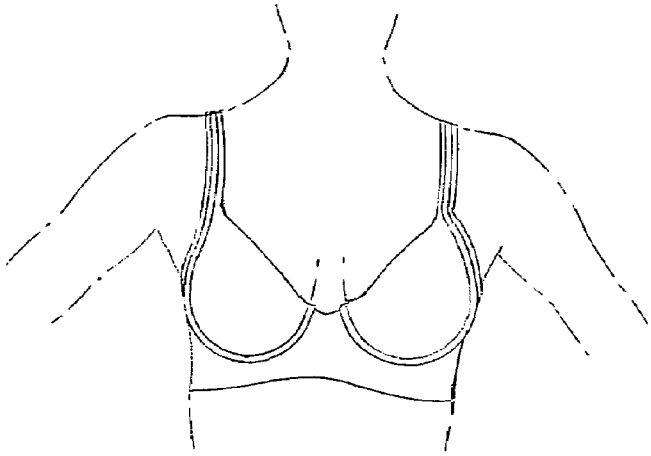
FIG. 7 shows an example of a banded underwire brassiere.
Figure 8:
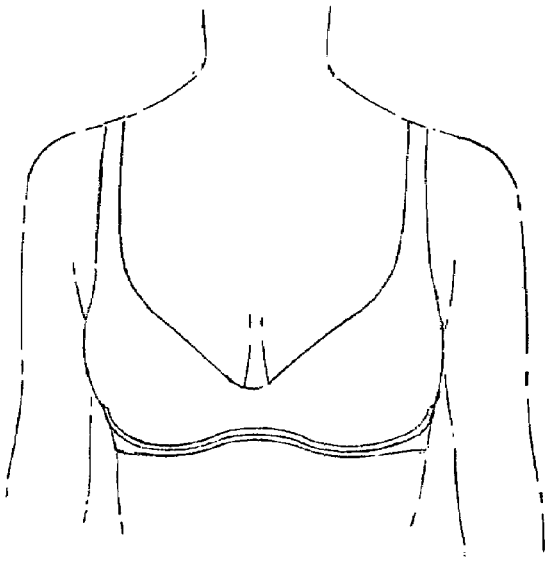
FIG. 8 shows an example of a hidden underwire brassiere.
Figure 9:
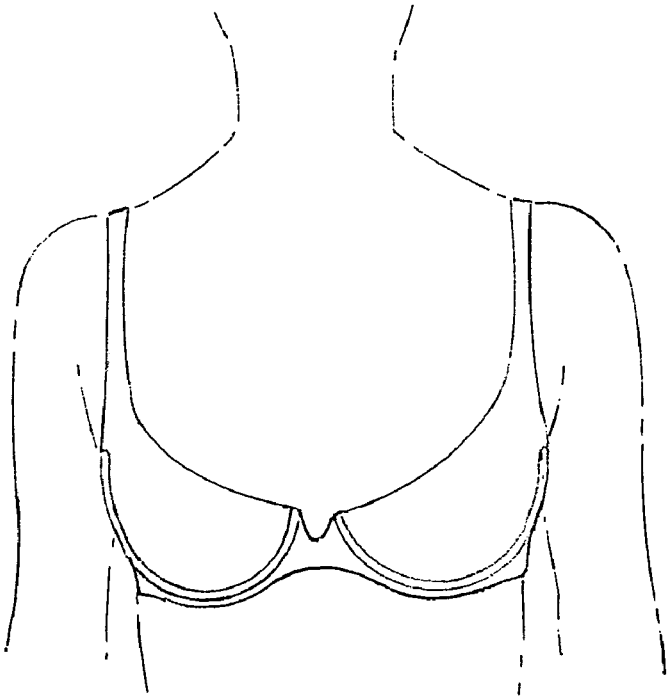
FIG. 9 shows an example of a demi cup underwire.
Figure 10:
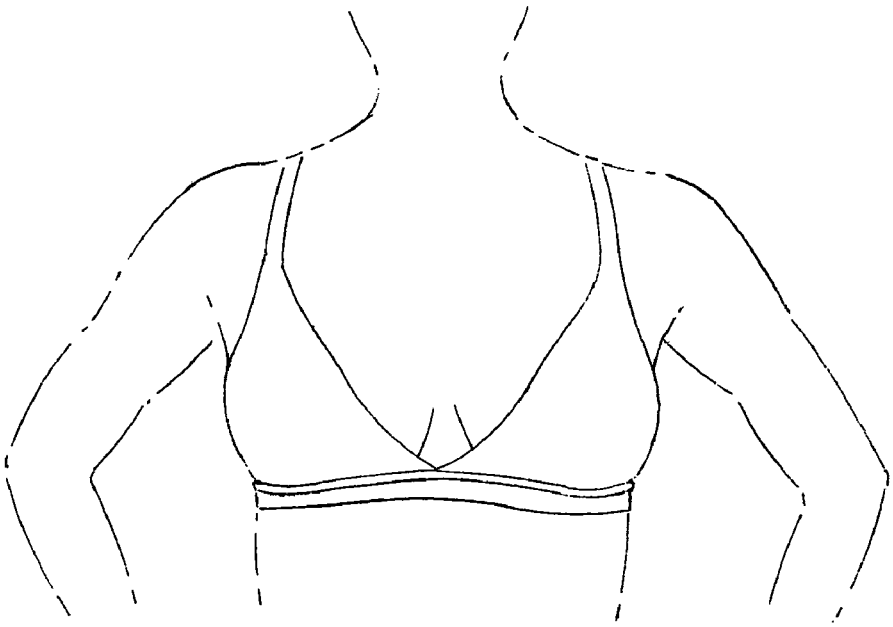
FIG. 10 shows an example of a triangle soft cup minimal bra.

FIG. 6 to FIG. 14 schematically shows a model wearing various brassieres according to the invention. In particular, FIG. 6 to FIG. 10, show non-limiting examples of various brassiere silhouettes that can be implemented with the present invention. FIG. 6 shows an example of an unwired soft cup brassiere. FIG. 7 shows an example of a banded underwire brassiere. FIG. 8 shows an example of a hidden underwire brassiere. FIG. 9 shows an example of a demi cup underwire brassiere. FIG. 10 shows an example of a triangle soft cup minimal brassiere.

Figure 11:
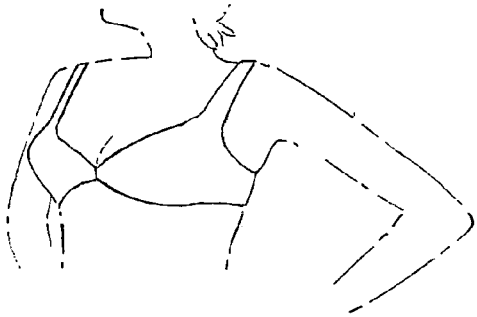
FIG. 11 shows brassiere and model positions for an "Arms Normal" test.
Figure 12:
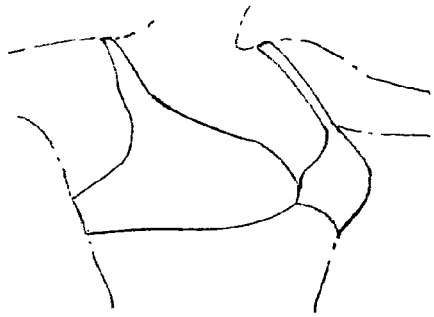
FIG. 12 shows brassiere and model positions for an "Arms Laterally Extended" test.
Figure 13:
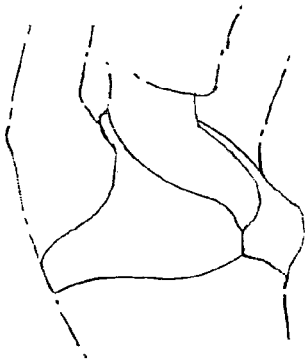
FIG. 13 shows brassiere and model positions for an "Arms Up" test.
Figure 14:
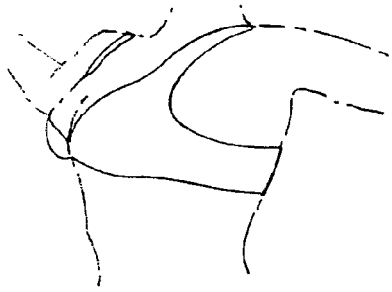
FIG. 14 shows brassiere and model positions for an "Arms Left to Right" test.

Each of FIG. 11 to FIG. 14 represents various brassiere and model positions to demonstrate support and "shaping ability". FIG. 11 shows the brassiere and model positions for the "Arms Normal" tests. FIG. 12 shows the brassiere and model positions for the "Arms Laterally Extended" tests. FIG. 13 shows the brassiere and model positions for the "Arms Up" tests. FIG. 14 shows the brassiere and model positions for the "Arms Left to Right" tests.

The body postures shown in FIG. 11 to FIG. 14 attempt to rearrange the bust by moving the body along its different anatomic axes. These movements, in combination with pressure sensitive equipment and body scans, scope out the contact between bust and brassiere and the overall bust shaping. In the "Arms Normal" posture of FIG. 11, the hands rest at the waist and the wearer breathes naturally. This is a neutral posture where the bust is configured at the absence of movement. In the "Arms Up" posture of FIG. 12, the whole upper body is pushed upwards resulting in maximum extension of skin and muscles. This position yields maximum tendency of the bust to move upwards and tests the contact of bra and bust in a position of high skin extension. In the "Arms Extended Laterally" posture of FIG. 13, the bust rearranges along the plane made by the arms extended laterally. In this posture, the sensors measure the contact of bra and bust. In the "Arms From Left to Right" posture of FIG. 14, the body twists up to 90 degrees from the "Arms Extended Laterally" posture. In this posture, the rearrangement of the bust inside the bra along the plane made by the extended arms is combined with a twisting effect. As such, the contact of the bra to bust as well as the overall bust shaping is severely tested.

Figure 22:
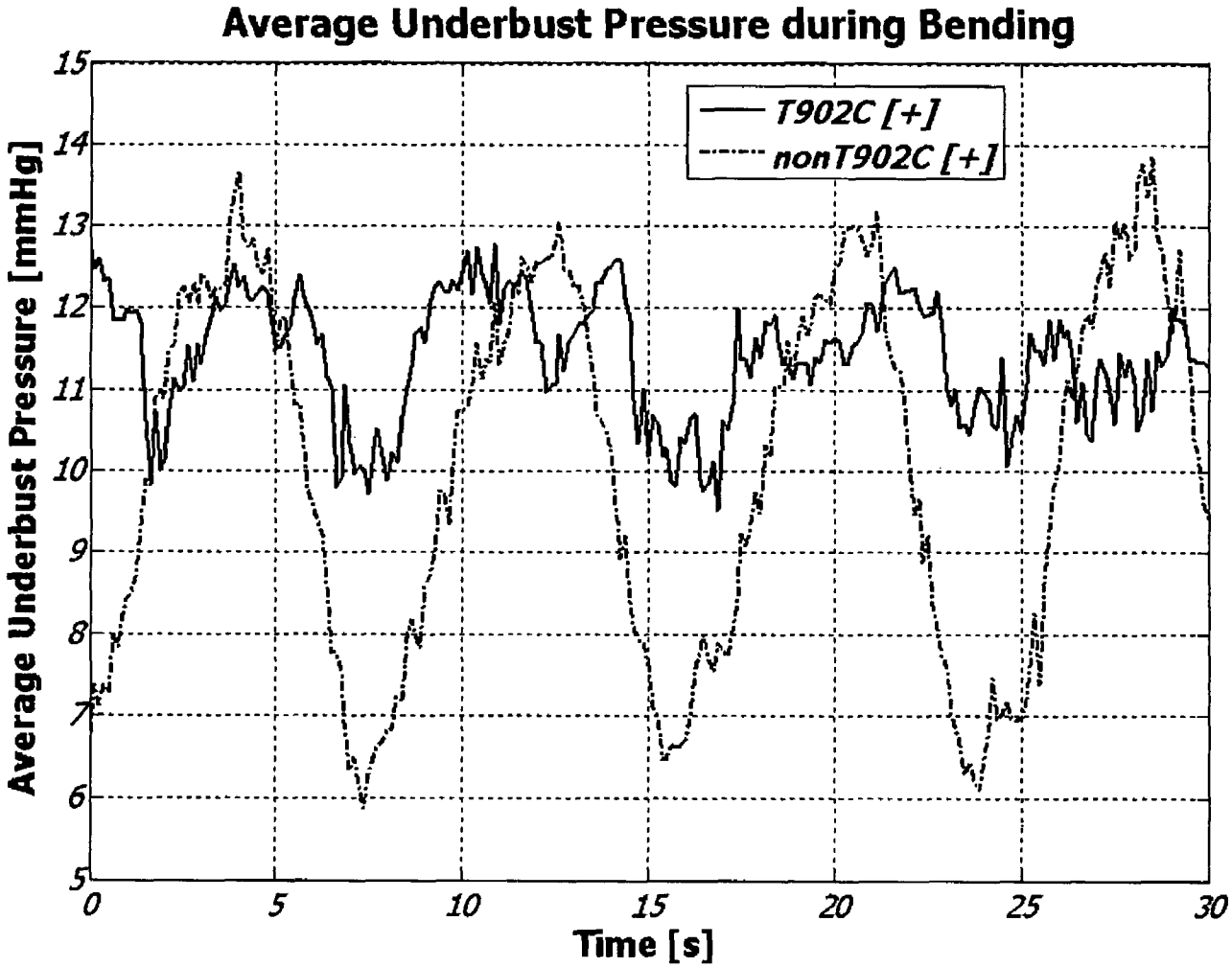
FIG. 22 shows a graph comparing the average pressure under the bust in a brassiere cup for a brassiere construction when the wearer is bending at the waist.

The pressures exerted by the garment on the body were measured and evaluated to determine fit and comfort properties of the test garments. A 3-D Body Scanner (model VITUS PRO commercially available from Vitronic of Wiesbaden, Germany) has 16 3-D cameras and 4 color cameras and produces body scan files which can be processed by ScanWorX 3D Body Scanner software (commercially available from Human Solutions of Troy, Mich.). A 3D Pressure system (commercially available from TekScan Inc. of Boston, Mass.) utilizes film like pressure sensors to assess the pressure between two surfaces. This film sensor is inserted between the wearer's bust and the bra. The 3D time-dependent pressure profile in FIG. 22 is recorded on a computer as the wearer goes through a routine of exercises from standing at rest and touching the toes.

The 3D Body Scanner scans the external surface or shape of the body. Volume distribution in FIG. 15 to FIG. 19 is the plot of differential volume (i.e., cross-section surface area) versus height. At any height from the 3D scan one can calculate the surface area of the slice of the body at that height. From the same slice one can calculate the true and tape circumferences. The true circumference is the true perimeter of the slice, whereas the tape circumference is the circumference that the slice would have if one was measuring it using a flexible tape, FIG. 20 to FIG. 21.

Figure 15:
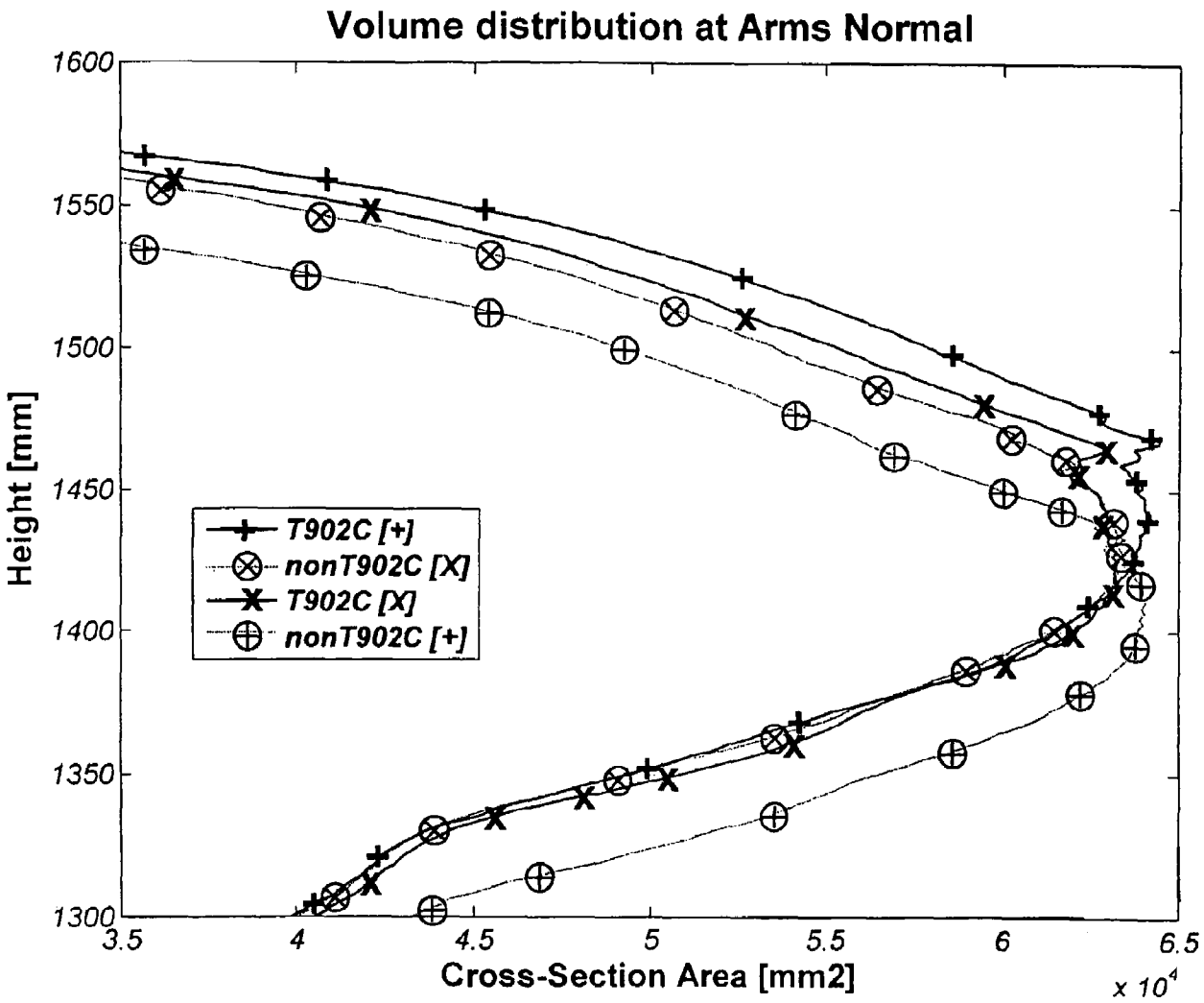
FIG. 15 shows a graph comparing the volume distribution of the body including the breast in a brassiere cup for the brassiere constructions when the wearer is in the "Arms Normal" position.

FIG. 15 shows a graph comparing the volume distribution of brassiere constructions when the wearer is in the "Arms Normal" position shown in FIG. 11. The graph of FIG. 15 compares the performance of a garment made with conventional spandex and a garment of the present invention when using brassiere constructions with both the "plus (+)" and "cross (X)" orientation of the fabric layers of the cup. Comparisons were made directly between "+" and "X" constructions in these comparative garments. The graph in FIG. 15 indicates that the garment of the present invention, using both the "+" and "X" constructions, provided more lift (i.e., shaping ability) for the breast than did the garment made with conventional spandex using the same brassiere construction. This additional lift indicates that the brassiere constructions using the garment of the present invention can be better at following the movement of the breasts. By varying the angles $\Theta_1$ and $\Theta_2$ (e.g., as described above), it may be possible to change the bust appearance, shape, and volume by changing the cup construction.

Figure 16:
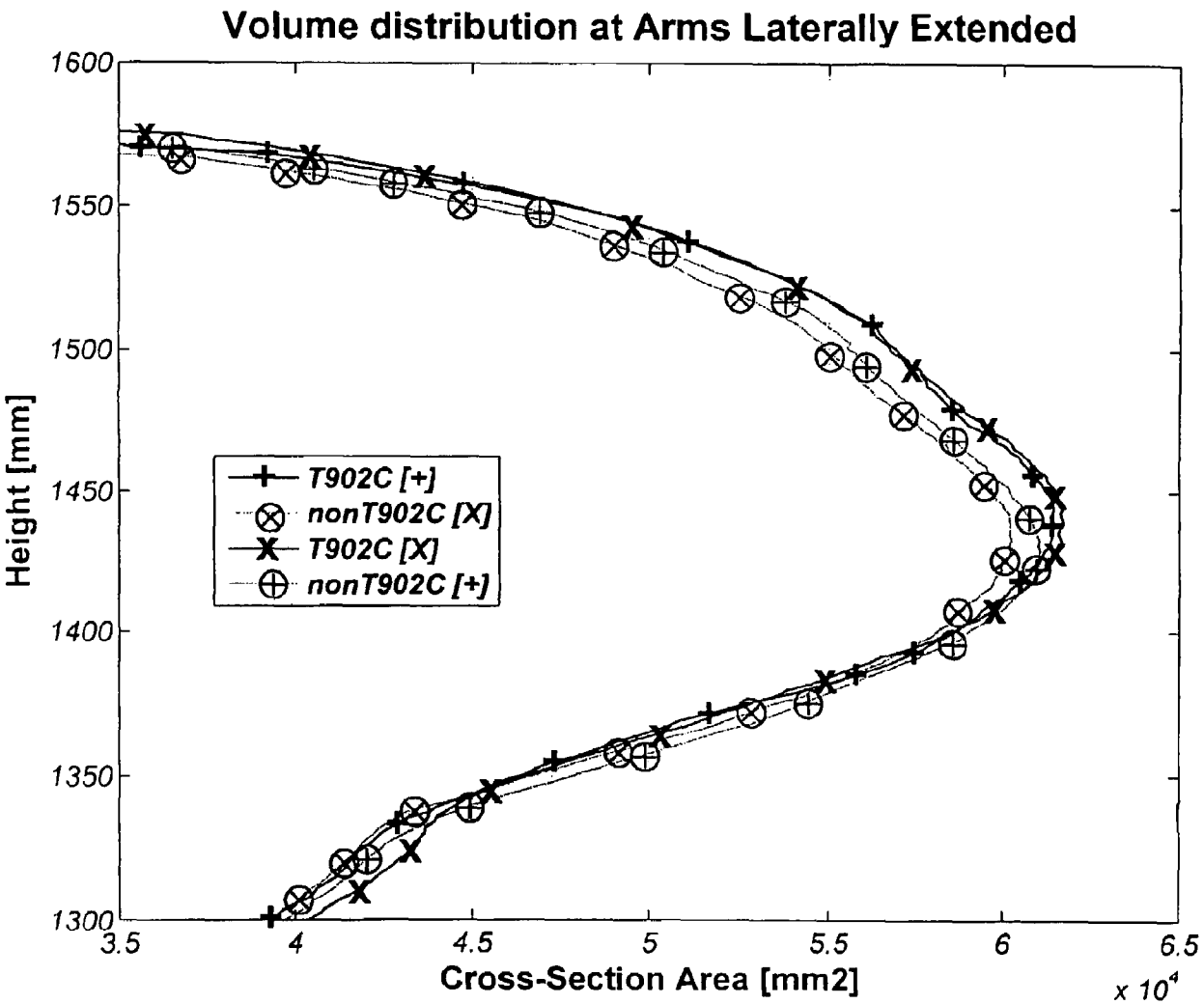
FIG. 16 shows a graph comparing the volume distribution of the body including the breast in a brassiere cup for the brassiere constructions when the wearer is in the "Arms Laterally Extended" position.

FIG. 16 shows a graph comparing the volume distribution of brassiere constructions when the wearer is in the "Arms Laterally Extended" position shown in FIG. 12. The graph of FIG. 16 compares the performance of a garment made with conventional spandex and a garment of the present invention when using brassiere constructions with both the "plus (+)" and "cross (X)" orientation of the fabric layers of the cup. Comparisons were made directly between "+" or "X" constructions in these comparative garments. The graph in FIG. 16 indicates that the garment of the present invention, using both the "+" and "X" brassiere constructions, provided more shaping ability in terms of lift than did the garment made with conventional spandex using the same brassiere construction. This additional lift indicates that the brassiere constructions using the garment of the present invention are better at following the movement of the breasts.

Figure 17:
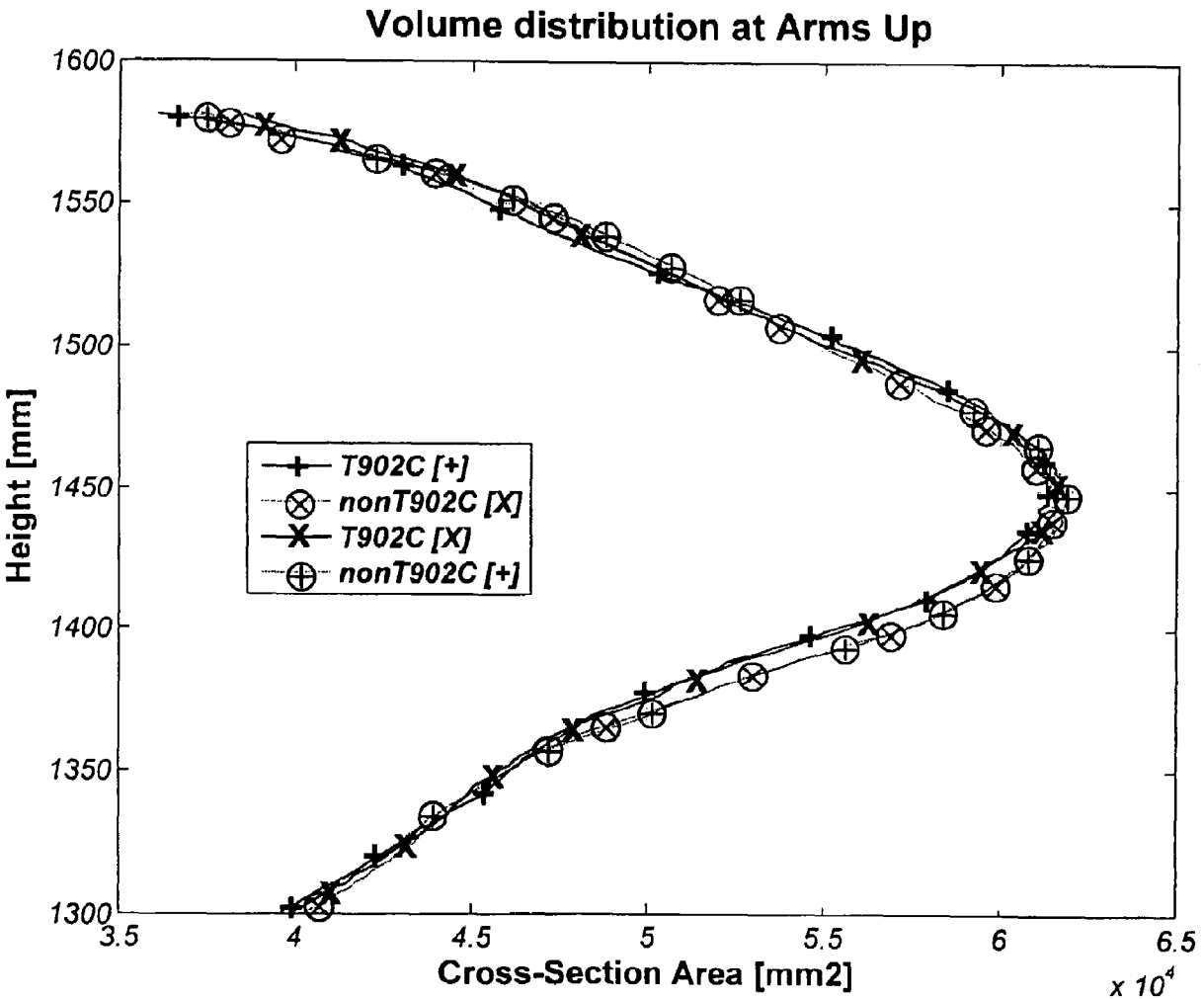
FIG. 17 shows a graph comparing the volume distribution of the body including the breast in a brassiere cup for the brassiere constructions when the wearer is in the "Arms Up" position.

FIG. 17 shows a graph comparing the volume distribution of brassiere constructions when the wearer is in the "Arms Up" position shown in FIG. 13. The graph of FIG. 17 compares the performance of a garment made with conventional spandex and a garment of the present invention when using brassiere constructions with both the "plus (+)" and "cross (X)" orientation of the fabric layers of the cup. Comparisons were made directly between "+" and "X" constructions in these comparative garments. The graph in FIG. 17 indicates that the garment of the present invention, using both the "+" and "X" brassiere constructions, has a reduced volume than the garment made with conventional spandex using the same brassiere constructions at a given height. This reduced volume indicates that the brassiere constructions using the garment of the present invention are better at following the movement of the breasts when the wearer is in the "Arms Up" position.

Figure 18:
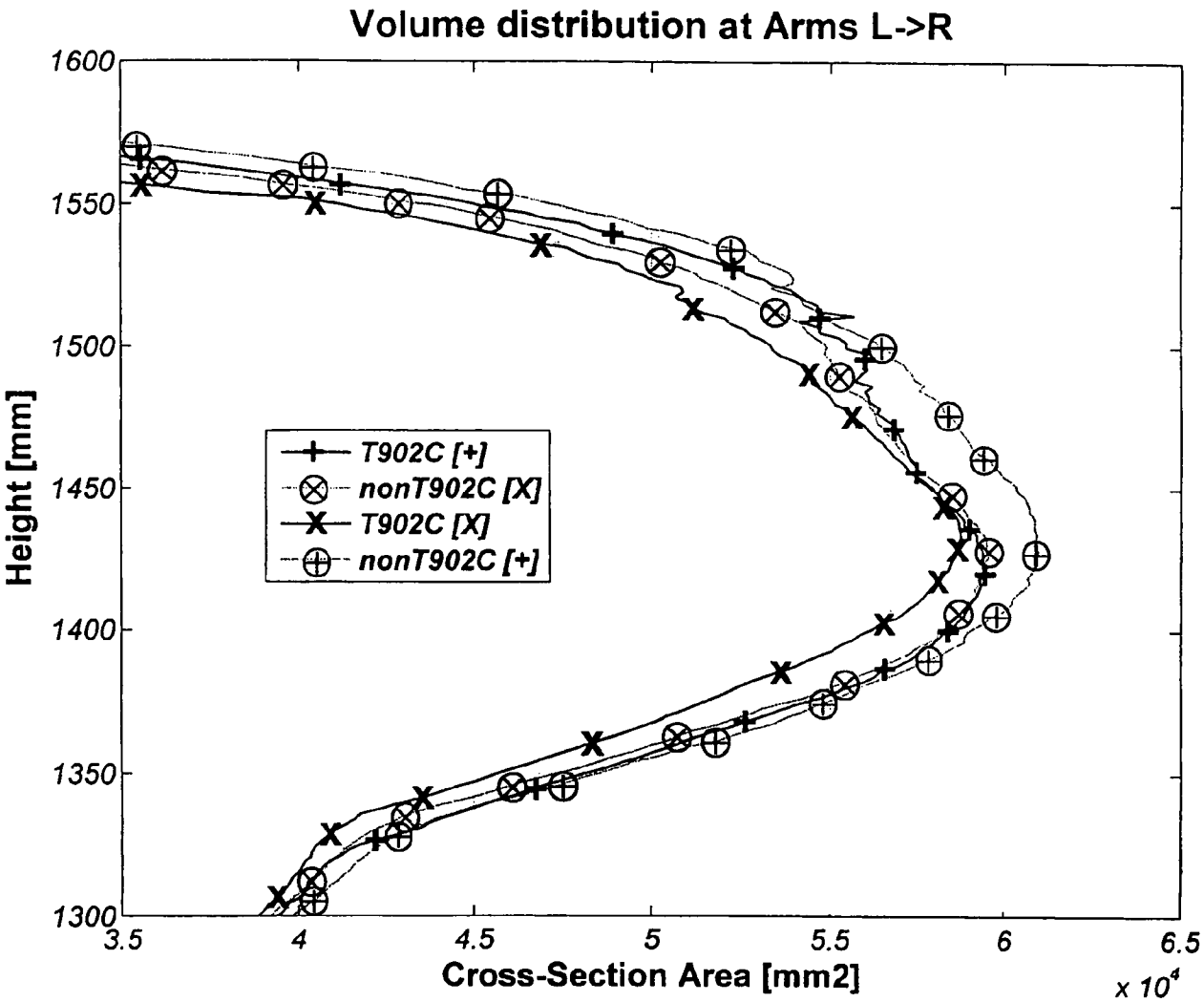
FIG. 18 shows a graph comparing the volume distribution of the body including the breast in a brassiere cup for the brassiere constructions when the wearer is in the "Arms Left to Right" position.

FIG. 18 shows a graph comparing the volume distribution of brassiere constructions when the wearer is in the "Arms Left to Right" position shown in FIG. 14. The graph of FIG. 18 compares the performance of a garment made with conventional spandex and a garment of the present invention when using brassiere constructions with both the "plus (+)" and "cross (X)" orientation of the fabric layers of the cup. Comparisons were made directly between "+" and "X" constructions in these comparative garments. The graph in FIG. 18 indicates that the garment of the present invention, using both "+" and "X" brassiere constructions, had a reduced volume as compared to the garment made with conventional spandex using both the "+" and "X" brassiere constructions at a given height. This reduced volume for the garment of the present invention indicates the garment is better at following the movement of the breasts than the garment with conventional spandex when the wearer is in the "Arms Left to Right" position.

Figure 19:
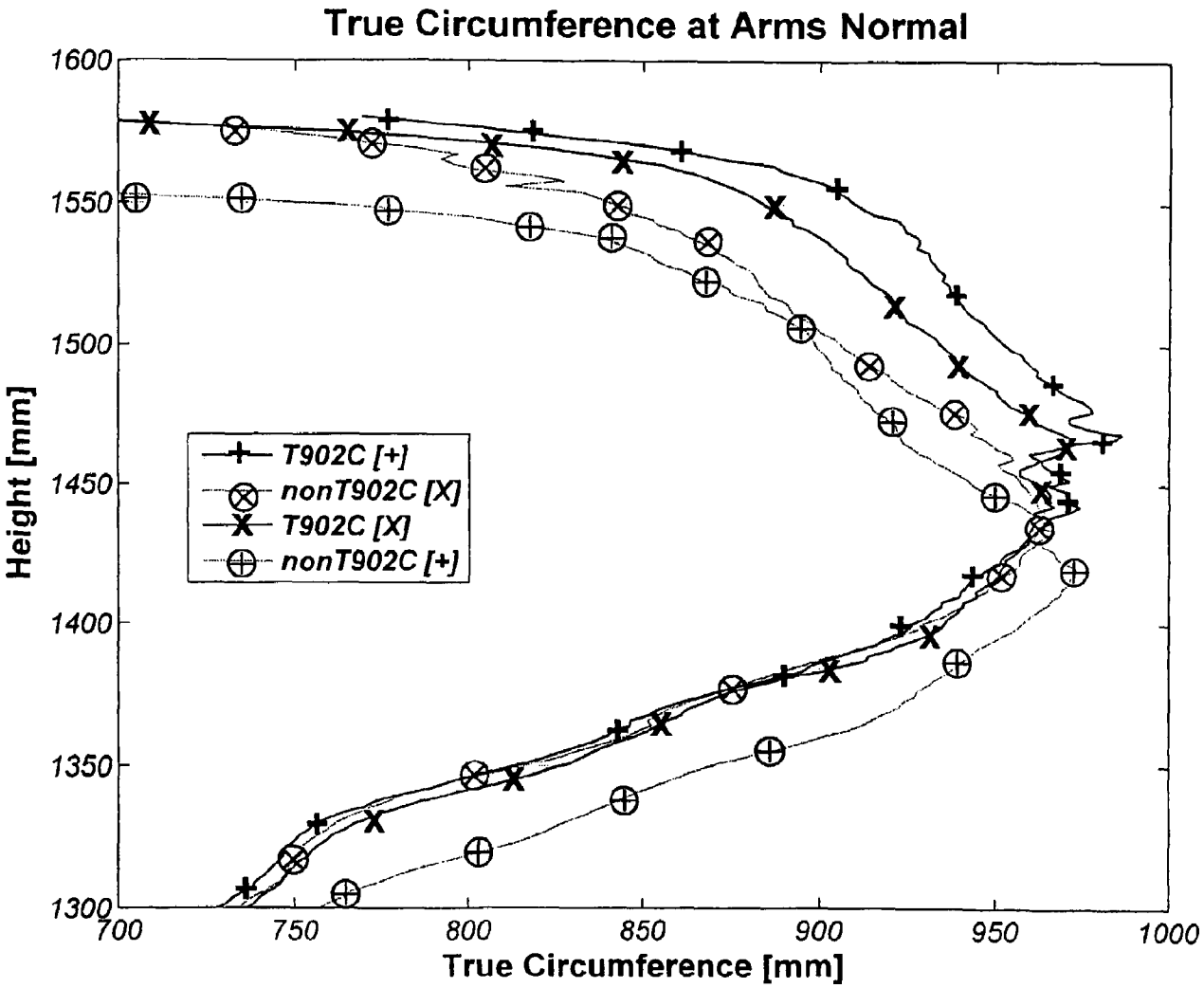
FIG. 19 shows a graph comparing the true circumference of the body including the breast in a brassiere cup for the brassiere constructions when the wearer is in the "Arms Normal" position.

FIG. 19 shows a graph comparing the true circumference of brassiere constructions when the wearer is in the "Arms Normal" position shown in FIG. 11. The graph of FIG. 19 compares the performance of a garment made with conventional spandex and a garment of the present invention when using brassiere constructions with both the "plus (+)" and "cross (X)" orientation of the fabric layers of the cup. Comparisons were made directly between "+" and "X" constructions in these comparative garments. The graph in FIG. 19 indicates that the garment of the present invention, using both the "+" and "X" constructions, provides more circumference (i.e., better lift and fuller bust) at a given height for the breast than the garment made with conventional spandex using the same brassiere constructions. This additional circumference indicates that the brassiere constructions using the garment of the present invention are better than garments made with conventional spandex at following the movement of the breasts.

Figure 20:
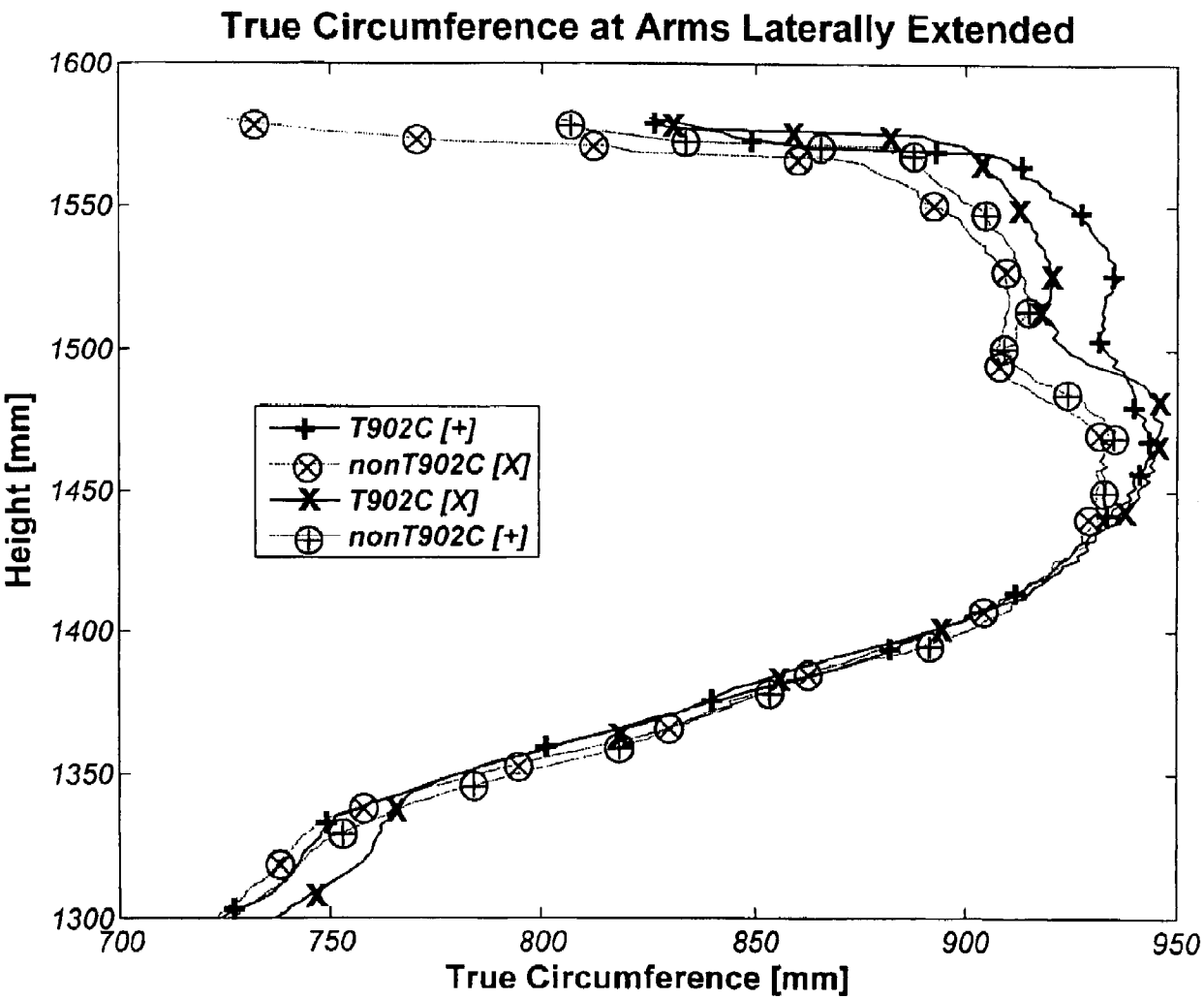
FIG. 20 shows a graph comparing the true circumference of the body including the breast in a brassiere cup for the brassiere constructions when the wearer is in the "Arms Laterally Extended" position.

FIG. 20 shows a graph comparing the true circumference of brassiere constructions when the wearer is in the "Arms Laterally Extended" position shown in FIG. 12. The graph of FIG. 20 compares the performance of a garment made with conventional spandex and a garment of the present invention when using brassiere constructions with both the "plus (+)" and "cross (X)" orientation of the fabric layers of the cup. Comparisons were made directly between "+" and "X" constructions in these comparative garments. The graph in FIG. 20 indicates that the garment of the present invention spandex, using both the "+" and "X" brassiere constructions, provides better lift and fuller bust in terms of true circumference at a given height than the garment made with conventional spandex using the same brassiere constructions. This circumference indicates that the brassiere constructions using the garment of the present invention are better at following the movement of the breasts.

Figure 21:
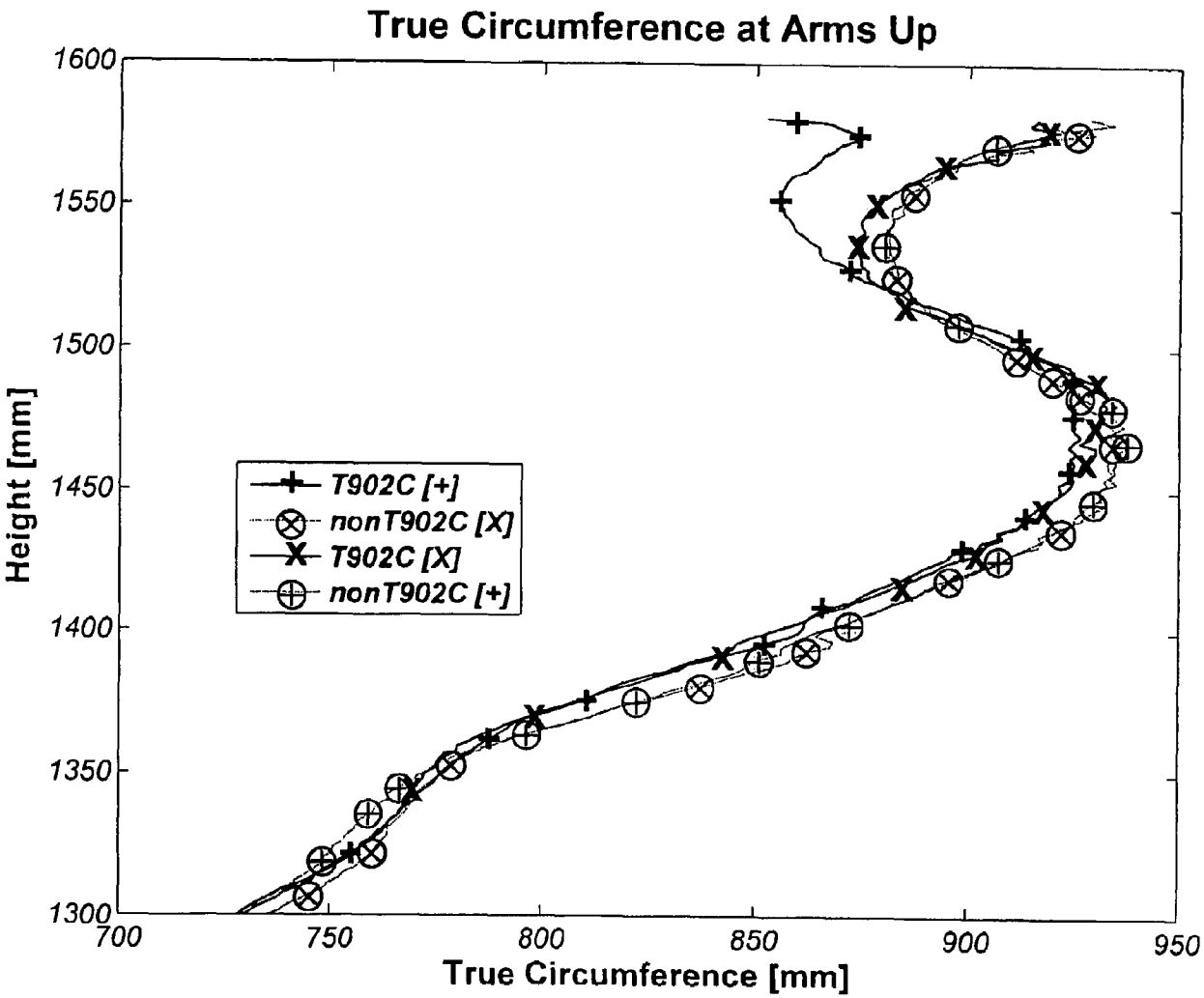
FIG. 21 shows a graph comparing the true circumference of the body including the breast in a brassiere cup for the brassiere constructions when the wearer is in the "Arms Up" position.

FIG. 21 shows a graph comparing the true circumference of brassiere constructions when the wearer is in the "Arms Up" position shown in FIG. 13. The graph of FIG. 21 compares the performance of a garment made with conventional spandex and a garment of the present invention when using brassiere constructions with both the "plus (+)" and "cross (X)" orientation of the fabric layers of the cup. Comparisons were made directly between "+" and "X" constructions in these comparative garments. The graph in FIG. 21 indicates that the garment of the present invention, using both the "+" and "X" brassiere constructions, has a reduced circumference as compared than the garment made with conventional spandex using the same brassiere constructions at a given height. This reduced circumference indicates that the brassiere constructions using the garment of the present invention are better at following the movement of the breasts when the wearer is in the "Arms Up" position.

FIG. 22 shows a graph comparing the average pressure under the bust in a brassiere cup for brassiere construction (+) when the wearer is exercising starting from a standing position and bending at the waist touching the toes. This exercise is repeated four times. During bending, the pressure variation is 4-5 times larger for the garment made with conventional spandex compared to the garment of the present invention. This is demonstrated in FIG. 22 where the average underbust pressure (average of 40 sensels sampled at frequency of 10 Hz) is plotted against time. In FIG. 22, the large pressure swings for the garment made with conventional spandex illustrate a loss of contact between the bust and the garment. Whereas the smaller pressure variations measured for the garment of the present invention illustrate that the loss contact between the garment and the bust is minimal. This means that the brassiere made according to the present invention remains in position with respect to the bust.

In summary, the above graphs (i.e., FIG. 15 to FIG. 22) provide experimental evidence confirming the improved performance of low bust compression and nearly isotropic hysteresis fabrics, for example LYCRA® T902C spandex fabrics, in the brassiere construction and cup design in the garment of the present invention. This construction and design provides improved comfort, shaping and support for body shaping garments such as brassieres, shape-wear and swim suits. The garments of the present invention may better maintain contact with the bust and torso and provide desired shaping with minimal slippage and maximum wearer comfort during the movements described above, as demonstrated by both scanner and pressure results.

EXAMPLES

Analytical Methods

Hysteresis measured on Instron Tensiometer: A Merlin Instron (model 5500R, commercially available from Instron in Norwood, Mass.) was used with clamps allowing for a 5 cm width fabric to be attached. The clamps were placed at an initial distance of 10 cm. Fabric pieces (approximately 20 cm by 5 cm) were cut along first the length (warp) and then the width (weft) directions. After being cut, the fabric samples were left to rest for about 20 minutes. In each experiment the strain rate was set to 900 mm/min and the extension was carried out from 0 to 100% of the initial clamps distance of 10 cm and then back to 0%. The two layered fabric sample was positioned between the clamps and extended from 10 to 20 cm and then back to 10 cm. This process (cycle) was repeated more than 5 times to obtain results that do not change from one cycle to the next. The last cycle was used to extract all relevant dynamic and mechanical information. Results were recorded in the standard Instron RAW file and then processed using standard mathematical software such as Matlab (commercially available from Mathworks in Natick, Mass.). The Instron Load and Unload curves of the last cycle were then fitted using least squares cubic splines. Using the fitted splines representation of the Load and Unload curves the Hysteresis of the curve can be calculated as follows:

$$\text{Hysteresis} = \int_0^{0.1} (F_{Load} - F_{Unload})dL$$

where 0 and 0.1 are in m and represent the fabric extension during the experiment and $F_{load}$ and $F_{unload}$ are the fitted cubic least squares splines for the load and unload curves of the last cycle. In the above formula, L is in m and F is in N, while Hysteresis is in J.

EXAMPLES

| | Hysteresis [J] | | | S = Std dev/ |
|---|---|---|---|---|
| Fabric | L&L | W&W | L&W | mean *100% |
| 1A | 0.1139 | 0.1121 | 0.1151 | 1.33 |
| 1C | 0.1796 | 0.0804 | 0.1204 | 39.40 |
| 2C | 0.0982 | 0.1555 | 0.1259 | 22.60 |

The last column of the table, (S), provides a means to look at the variation of the three results: L&L, W&W, and L&W for each fabric. It is the standard deviation of the 3 measurements divided by the mean and then multiplied by 100%.

Fabric 1A (commercially available from Penn Asia, Thailand) was made with LYCRA® T902C spandex and the S value was within the limits for the invention. Fabric 1C (commercially available from H. Warshow and Sons, Inc., Milton, Pa.) was made with Lycra® T162B spandex and the S value is too high for the invention. Fabric 2C (commercially available from Ruey Tay, Taipei, Taiwan) was made with LYCRA® T902C spandex and the S value is too high for the invention.

The foregoing description illustrates and describes the present invention. Additionally, the disclosure shows and describes only the embodiments of the invention, but as mentioned above, it is to be understood that the invention is capable of use in various other combinations, modifications, and environments and is capable of changes or modifications within the scope of the concept of the invention as expressed herein, commensurate with the above teachings and/or skill or knowledge of the relevant art. The embodiments described herein above are further intended to explain best modes known of practicing the invention and to enable others skilled in the art to utilize the invention in such or other embodiments and with the various modifications required by the particular applications or uses of the invention. Accordingly, the description is not intended to limit the invention to the form or application disclosed herein. Also, it is intended that the appended claims be construed to include alternative embodiments.

We claim:

1. A body-shaping garment, comprising:

a breast-receiving cup having an inner fabric layer and an outer fabric layer, wherein the inner fabric layer defines a first X-X' axis and first Y-Y' axis and the outer fabric layer defines a second X-X' axis and second Y-Y' axis, and the inner fabric layer and outer fabric layer are oriented such that the first X-X' axis of the inner fabric layer is at a first angle $\Theta_1$ to the second X-X' axis of the outer fabric layer, and wherein the inner fabric layer and the outer fabric layer incorporate a material having hysteresis values for each fabric layer with an S value defined by:

$$S = \frac{\mathrm{std}(H_{L\&L}, H_{W\&W}, H_{L\&W})}{\mathrm{mean}(H_{L\&L}, H_{W\&W}, H_{L\&W})} \times 100\% \leq 10\%$$

wherein std is standard deviation, the inner fabric layer and the outer fabric layer each have a length and a width, $H_{L\&L}$ is the hysteresis value of the combined inner fabric layer and outer fabric layer cut along the length, H is the hysteresis value of the combined inner fabric layer and outer fabric layer cut along the width and H is the hysteresis value of the combined inner fabric layer and outer wherein one of the inner and outer fabric layers is cut along the width and the other of the inner and outer fabric layers is cut along the length.

2. The garment of claim 1, wherein the first angle $\Theta_1$ is an angle selected from 15 degrees to 165 degrees.

3. The garment of claim 1 wherein the inner fabric layer and the outer fabric layer are oriented such that the first X-X' axis of the inner fabric layer is at a second angle $\Theta_2$ from a horizontal axis defined by the garment, and wherein the second angle $\Theta_2$ is an angle selected from 0-180 degrees.

4. The garment of claim 1, wherein the inner fabric layer and the outer fabric layer are selected from the group consisting of circular knit, tricot warp knit, raschel warp knit, lace, flat knit, woven, nonwoven fabric, and combinations thereof.

5. The garment of claim 1, wherein the inner fabric layer and the outer fabric layer each contain a copolyether-base spandex.

6. The garment of claim 1 wherein the inner fabric layer and the outer fabric layer are molded.

7. The garment of claim 1, wherein the garment is a brassiere with a pair of cups, and wherein said pair of cups is selected from full, half and partial coverage types.

8. The garment of claim 6, wherein the inner fabric layer is joined to the outer fabric layer.

9. The garment of claim 8, wherein the garment comprises:

a left cup;

a left wing part;

a left shoulder strap;

a bridge;

a right cup;

a right wing part;

a right shoulder strap;

a fastener; and a mating fastener, and wherein the left cup is attached at one edge to the left wing part and at another edge to one end of the bridge, the left shoulder strap is connected at one end to a distal end of the left wing part and at an other end to an upper part of the left cup, the right cup is attached at one edge to the right wing part and at an other edge to one end of the bridge, the right shoulder strap is connected at one end to a distal end of the right wing part and at an other end to an upper part of the right cup, and the fastener is connected to the distal end of the right wing part and the mating fastener is connected to the distal end of the left wing part.

10. The garment of claim 9, wherein each of said right cup and said left cup further comprises a sheath and an underwire contained within the sheath.

11. The garment of claim 9, wherein the garment comprises a brassiere selected from the group consisting of at least one of an unbanded underwire, a banded underwire, a hidden underwire, a demi-cup underwire, a soft cup invisible support and a triangle soft cup minimal bra.

12. The garment of claim 9 wherein the cups each comprise two to five layers of fabric.

13. The garment of claim 1 wherein said garment is a brassiere.

14. The garment of claim 1 wherein said garment is a swimsuit.

* * * * *